United States Patent [19]

Matucheski

[11] 4,120,257

[45] Oct. 17, 1978

[54] SHEET METAL FAN BLADE FORMING PROCESS

[75] Inventor: Joseph Victor Matucheski, Indianapolis, Ind.

[73] Assignee: Wallace Murray Corporation, New York, N.Y.

[21] Appl. No.: 799,983

[22] Filed: May 24, 1977

[51] Int. Cl.[2] ..... B63B 19/00

[52] U.S. Cl. ..... 113/116 D; 29/156.8 B; 416/236 R; 416/DIG. 3

[58] Field of Search ..... 113/116 D, 116 R; 29/156.8 B, 156.8 P, 156.8 T; D23/165; 416/DIG. 3, 236 R, 223 R

[56] References Cited

U.S. PATENT DOCUMENTS 2,240,597 5/1941 Whitfield ..... 416/223 R

*Primary Examiner*—Leon Gilden

*Attorney, Agent, or Firm*—Thomas J. Greer, Jr.

[57] ABSTRACT

A method of making a sheet metal fan blade having a flattened mounting pad. The blade is to be attached to a flat spider arm of a fan hub. According to the method, a fan blade blank workpiece of cylindrical stock and of any desired outline (such as rectangular, trapezoidal, etc.) is simultaneously provided with a longitudinally running rib and a flat pad portion by stamping. In this manner, the outline of the blade is not distorted by stamping the cylindrical blank to form the flat mounting pad.

3 Claims, 5 Drawing Figures

SHEET METAL FAN BLADE FORMING PROCESS

This invention relates to a process for forming a sheet metal fan blade of a type particularly adapted to be employed in conjunction with the fan in an automotive cooling system. It will be understood that this use of the fan is merely illustrative and the invention is susceptible of use in any fan environment. In the formation of certain types of fans, it is desirable from an aerodynamic efficiency standpoint to make the fan blade of cylindrical form and of any desired outline. Thus, the fan blade may be regarded as having been formed by cutting out a blank from a cylinder, with the longitudinal axis of the blank running parallel to the longitudinal axis of the cylinder. In such instances where a cylindrical blade is required, it is often convenient to mount such a blade on a flat spider arm of a fan hub. The fan blades themselves being of cylindrical form and the spider arms being flat, workers in this art have had to devise some method of further shaping of the fan blades in order that a portion thereof may be flat to thereby facilitate attachment to the spider arms. One method which has been utilized involves stamping the cylindrical blank to thereby define a flat mounting pad portion. This stamping has resulted in a distortion of the outline of the blank and accordingly a final blanking step has been required.

According to the practice of this invention such a final step is eliminated. This is done by simultaneously stamping the cylindrical blank or workpiece with a longitudinally running rib while the flat portion is formed. The longitudinally running rib extends from the radially inner end of the fan blade towards the outer end and generally centrally of the flattened pad.

IN THE DRAWINGS

Figure 1:
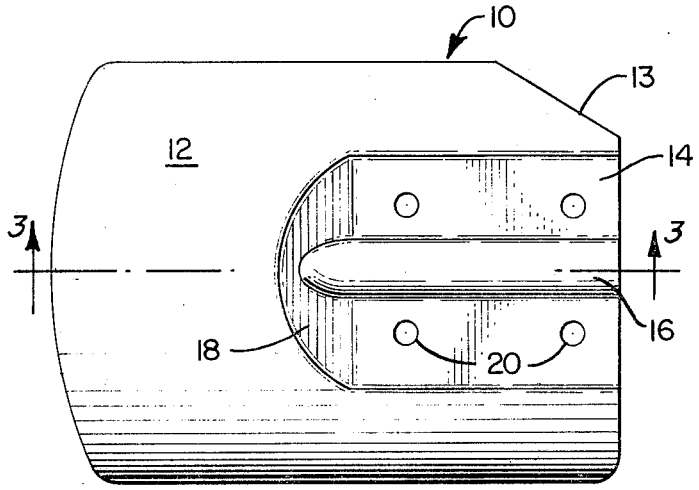
FIG. 1 is a plan view of a completed fan blade formed in accordance with the practice of this invention.

Referring now to FIG. 1 of the drawings, the numeral 10 denotes generally a fan blade of this invention adapted to be attached to a flat spider arm of a fan hub. The blade is formed from a workpiece or blank 12, the workpiece being of generally cylindrical contour as may be seen from a consideration of FIGS. 2 and 4. The term cylindrical, as used in the claims, is intended to embrace conical shapes as well as cylindrical shapes. A truncated portion 13 may be provided at one edge of the blade, although this portion forms no part of the invention. The numeral 14 denotes a flat mounting pad or portion which extends from the radially innermost end of the blade to a region more or less centrally of the blade. Inclined portion 18 connects the radially outermost section of the blade with the mounting pad. The numeral 16 denotes a centrally running rib also extending from the radially innermost portion of the blade to a central portion thereof. Preferably, the rib is formed as is the mounting pad, generally centrally of the blade, i.e., generally midway between its leading and trailing edges. The numeral 20 denotes apertures for the reception of fastening elements such as rivets or the like. The mounting pad 14 is attached to the end of a flat spider arm, not illustrated, by passing the fasteners through the apertures 20 to thereby secure the blade to the spider arm.

Figure 2:
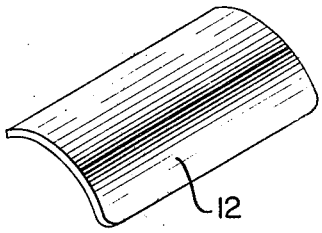
FIG. 2 is a perspective view of a cylindrical workpiece from which the fan blade of FIG. 1 is formed.
Figure 3:
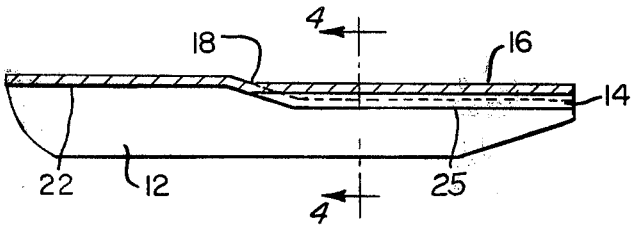
FIG. 3 is a view taken along section 3—3 of FIG. 1.
Figure 4:
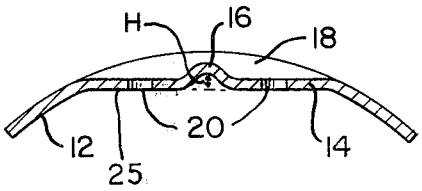
FIG. 4 is a view taken along section 4—4 of FIG. 3.

The formation of the blade shown at FIGS. 1, 3 and 4 is carried out in the following manner. Firstly, one commences with a cylindrically contoured workpiece 12 such as is shown at FIG. 2. Then, a stamping die set is formed which has a configuration similar to that shown at FIG. 4. Namely, the bottom die is flat except for a raised portion corresponding to rib 16, while the upper die is flat except for a concave rib corresponding to rib 16. The workpiece of FIG. 2 is now placed between the stamping dies and the stamping operation carried out by bringing the dies together. This results in the simultaneous formation of flat mounting pad 14 and rib 16. Preferably, the height of the rib 16 is not greater than the maximum depth of the pad 14. The depth of the pad 14 may be seen at FIGS. 3 and 4. Thus, with the numeral 22 denoting the lower surface of the curved blade portion (see FIG. 3) and the numeral 25 denoting the lower surface of the pad 14, the depth of the pad is the difference in vertical height between surfaces 22 and 25. Similarly, the height of the rib 16 is the vertical distance between surface 25 and the lower surface of the rib, and is designated by the letter H at FIG. 4.

Figure 5:
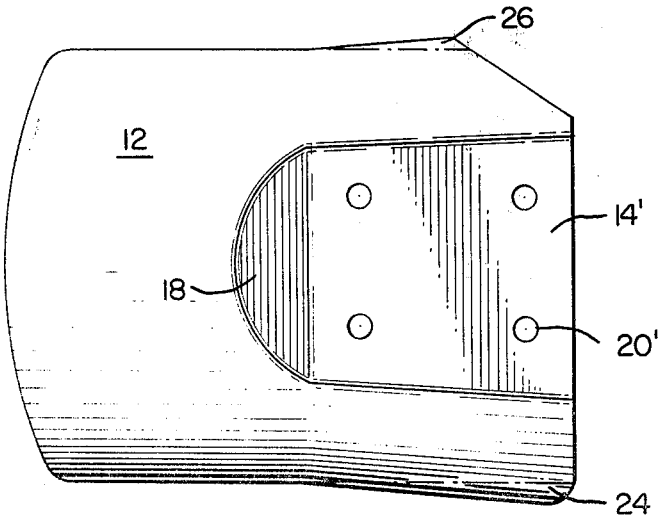
FIG. 5 is a view similar to FIG. 1 and illustrates a typical distortion of the workpiece such is shown at FIG. 1 with the practice of a prior method.

Referring now to FIG. 5, an illustration is offered of the usual distortion which accompanies the formation of the mounting pad by typical prior-art methods. Here, the mounting pad is denoted by the numeral 14' having apertures 20', with web 18 extending from the left portion of the mounting pad to the cylindrical portion of the workpiece. Portions 24 and 26 denote the distortion which often accompanies such deformation. The final blanking step with such prior-art procedures has involved the removal of portions 24 and 26. The simultaneous provision of rib 16 with the flat mounting pad precludes the distortion into regions such as 24 and 26 of FIG. 5. It will be understood that the fan blade may assume forms other than the generally rectangular outline illustrated. Thus, a trapezoidal form, an oval form, or any other desired form may be employed in the practice of this invention.

I claim:

1. A method of making a curved sheet metal fan blade from a sheet metal workpiece which is to be flattened over a portion thereof for subsequent superposed attachment to a flat mounting arm, including the steps of:

(a) forming a workpiece of generally cylindrical contour and of a desired outline, (b) stamping a rib on the workpiece, the rib extending from one edge of the workpiece towards another edge of the workpiece, (c) simultaneously flattening the workpiece by stamping at portions laterally of the rib to thereby form a flat mounting pad, the mounting pad adapted to be attached to a flat spider arm of a fan hub, (d) whereby step (c) will not cause departure from the initial workpiece outline.

2. The method of claim 1 wherein the height of the rib formed by stamping is made less than the maximum depth of the mounting pad.

3. The method of claim 1 wherein the mounting pad formed by stamping is made of a width less than the width of the workpiece.

* * * * *